US005566617A

United States Patent [19]

Durrnagel

[11] Patent Number: 5,566,617

[45] Date of Patent: Oct. 22, 1996

[54] METHOD FOR CLEANING A ROTATING CYLINDER IN A PRINTING MACHINE

[75] Inventor: Klaus Durrnagel, Bad Schwalbach, Germany

[73] Assignee: MAN Roland Druckmaschinen AG, Germany

[21] Appl. No.: 545,251

[22] Filed: Oct. 19, 1995

[30] Foreign Application Priority Data

Oct. 27, 1994 [DE] Germany ..... 44 38 347.9

[51] Int. Cl.[6] ..... B41F 35/00

[52] U.S. Cl. ..... 101/483; 101/423; 101/425; 15/256.52

[58] Field of Search ..... 101/423, 424, 101/425, 483; 15/256.52, 256.31

[56] References Cited

U.S. PATENT DOCUMENTS

| | | | |
|---|---|---|---|
| 3,120,805 | 11/1961 | Simon | 101/425 |
| 4,747,348 | 5/1988 | Jeschke et al. | 101/425 |
| 5,010,819 | 4/1991 | Uribe et al. | 101/425 |
| 5,181,470 | 1/1993 | Barrios et al. | 101/425 |

FOREIGN PATENT DOCUMENTS

| | | |
|---|---|---|
| AS 15 61 008 | 9/1970 | Germany . |
| OS 17 61 111 | 4/1971 | Germany . |
| 42 08 079 A1 | 9/1993 | Germany . |

*Primary Examiner*—Edgar S. Burr
*Assistant Examiner*—Dave A. Ghatt
*Attorney, Agent, or Firm*—Leydig, Voit & Mayer, Ltd.

[57] ABSTRACT

A method for cleaning a rotating cylinder in a printing machine, such as the rubber-blanket or impression cylinder, is disclosed. In accordance with the present invention, the printing machine includes a washing roller for engaging and cleaning the rotating cylinder. The washing roller is rotated in the same direction as the direction of rotation of the rotating cylinder during at least part of the period in which the washing surface of the washing roller engages the rotating cylinder. Preferably, the washing roller is first rotated in a direction opposite to the direction of rotation of the rotating cylinder, then reversed to rotate in the same direction as the direction of rotation of the rotating cylinder.

6 Claims, 1 Drawing Sheet

METHOD FOR CLEANING A ROTATING CYLINDER IN A PRINTING MACHINE

FIELD OF THE INVENTION

The present invention relates generally to printing machines, such as sheet-fed, offset printing machines, and particularly concerns a method for cleaning a rotating cylinder, such as a rubber-blanket cylinder, in a printing machine by using a washing roller.

BACKGROUND OF THE INVENTION

Sheet-fed, offset printing machines comprise a rotating plate cylinder that carries a printing plate to which is fed a supply of ink. The printing portions of the printing plate are inked by the supplied ink to thereby form an inked image on the printing plate. The plate cylinder engages a rotating rubber-blanket cylinder, or blanket cylinder, and transfers the inked image from the printing plate onto the rubber blanket disposed thereon. A sheet to be printed is fed to the printing machine between the blanket cylinder and a rotating impression cylinder. The inked image then is transferred from the rotating blanket cylinder onto the printed sheet.

The blanket cylinder carries a rubber blanket over only a portion of its circumferential surface. To retain the rubber blanket on the surface of the blanket cylinder, the blanket cylinder is provided with an axial channel in which means for retaining the rubber blanket are disposed. The useful printing portion of the blanket cylinder thus is bounded by a print start edge and a print end edge of the rubber blanket, the print start edge being that edge that leads during the rotation of said rotating cylinder with respect to the rubber blanket.

During the printing process, printing ink residue may remain on the blanket cylinder, or may be transferred to the impression cylinder. In addition, residue from the printed sheets, such as paper fluff, may settle onto the blanket cylinder and may be retained thereon. These print residues may impair the quality of the image printed by the printing machine, particularly when a new print order is run using a new printing plate. It is therefore necessary to periodically clean the blanket and impression cylinders.

The prior art has taught to provide a washing roller for cleaning the blanket or impression cylinders, the washing roller fluidically communicating with a source of washing fluid. When the washing roller is used to clean the blanket or impression cylinder, the surface of the washing roller is wetted with washing fluid to thereby provide a washing surface. The washing roller is movable between a cleaning position in which the washing surface engages the rotating blanket or impression cylinder and an idle position in which the washing surface does not engage the rotating blanket or impression cylinder. To clean one of the cylinders, for example, the blanket cylinder, the washing roller first is moved to its cleaning position. The washing roller then is rotated in a direction opposite the direction of rotation of the rotating blanket cylinder to thereby clean the rubber blanket.

This method allows the blanket or impression cylinder to be cleaned quickly. It has been observed, however, that many print residues still remain on the rotating cylinder after it is cleaned, particularly in the case of the blanket cylinder. Specifically, the print end edge of the rubber blanket is not cleaned completely by the washing roller, inasmuch as the washing roller tends to deposit the print residue onto the print end edge as it runs off the rubber blanket into the axial channel of the blanket cylinder. It is believed that this deposit may contribute to soiling of the printing sheets in the next print order. Although this deposit of print residue may be reduced by increasing the duration of the cleaning cycle, it is difficult to remove these deposits completely, and the increase in duration of the washing cycle is time consuming and uneconomical.

Accordingly, a need exists for a method for cleaning a rotating cylinder in a printing machine in which print residue deposits are reduced or eliminated, particularly at the print end edge of a rubber-blanket cylinder. It is a general object of the present invention to provide such a method for cleaning a rotating cylinder in a printing machine.

BRIEF SUMMARY OF THE INVENTION

The present invention provides a method for cleaning a rotating cylinder in a printing machine, such as the rubber-blanket or impression cylinder, by using a conventionally known washing roller. In accordance with the present invention, the washing roller is rotated in the same direction as the direction of rotation of the rotating cylinder during at least part of the period in which the washing surface of the washing roller engages the rotating cylinder. Thus, in a preferred embodiment, the method of the present invention comprises the steps of moving the washing roller to the washing position; rotating the washing roller in a direction opposite to the direction of rotation of the rotating cylinder to thereby clean at least a first portion of the rotating cylinder; and rotating the washing roller in the same direction as the direction of rotation of the rotating cylinder to thereby clean at least a second portion of the rotating cylinder.

BRIEF DESCRIPTION OF THE DRAWING

The Figure is a schematic view of a sheet-fed, offset printing machine, illustrating the blanket cylinder and the method of cleaning the blanket cylinder with a washing roller.

DESCRIPTION OF THE PREFERRED EMBODIMENTS

Figure 1:
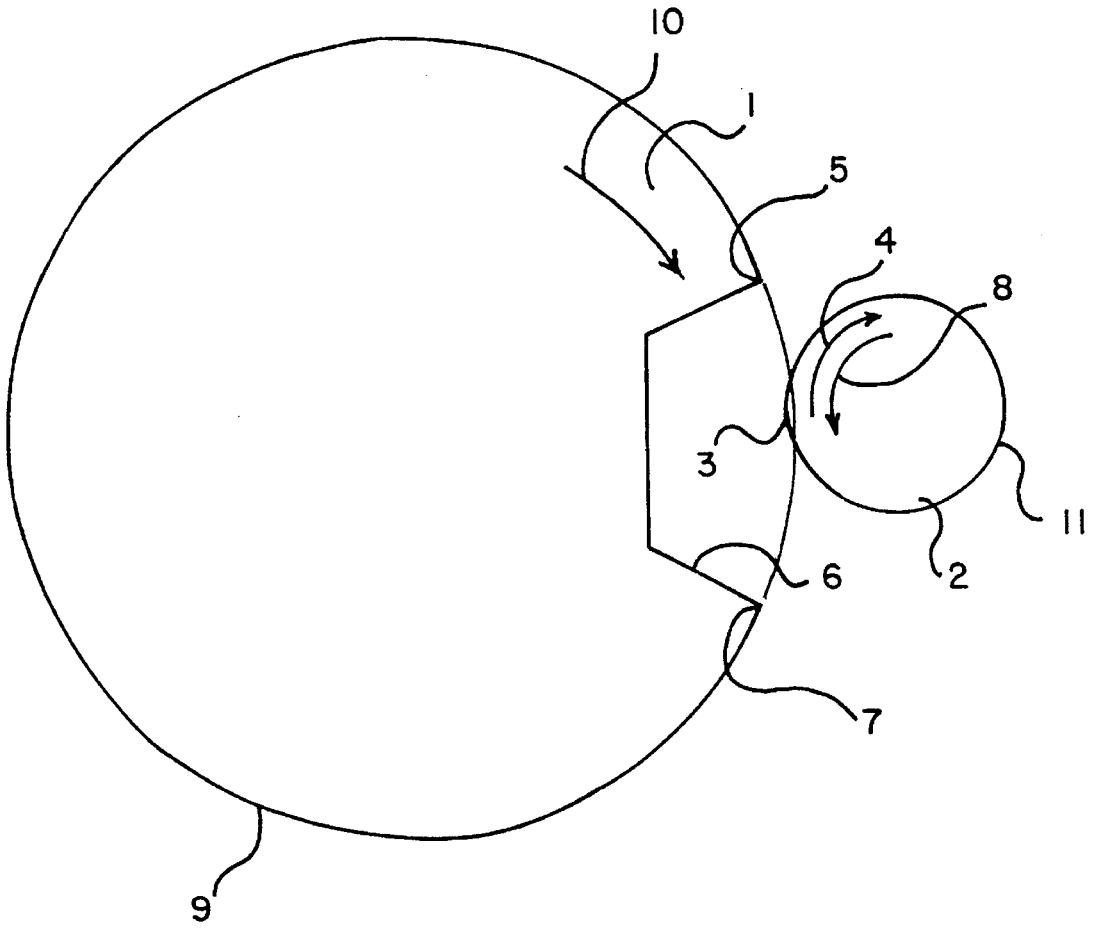

The present invention is derived from the knowledge that the print residue deposits tend to form at the print end edge, whereas the print start edge can be cleaned completely of print residue. Conventional washing rollers include a surface made of a soft-elastic, absorbent material. When the washing roller engages the rubber-blanket roller, it is slightly biased against the rubber-blanket roller, and accordingly tends to dip slightly into the axial channel when the axial channel passes beneath the washing roller. Accordingly, the print start edge of the rubber-blanket cylinder, and the channel wall immediately forward of the print start edge, are cleaned adequately when the washing roller passes over these portions. However, the pressure on the soft surface of the washing roller is relieved as the washing roller dips into the axial channel. This has the result of stripping print residue from the washing roller and depositing it onto the print end edge.

If the washing roller is reversed to run in the same direction as the direction of rotation of the rubber-blanket cylinder, in contradiction to the teachings of the art, any residue deposited on the print end edge is then removed by the washing roller. The blanket cylinder thus may be cleaned completely.

As shown in the Figure, the printing machine includes a rubber-blanket cylinder 1 which bears a rubber blanket 9 over a portion of its circumference. The rubber blanket 9 has a print start edge 5 and a print end edge 7. Thus, it is seen that, when the rubber-blanket cylinder rotates in the direction of arrow 10, the print start edge leads the print end edge with respect to the rubber blanket. The blanket cylinder 1 includes an axial channel 6, which preferably is continuous over the axial length of the blanket cylinder 1. Means (not shown) for retaining the rubber blanket 9 at the print start edge 5 and print end edge 7 are disposed within the channel 6. Preferably, the means for retaining the rubber blanket 9 provide tension in the rubber blanket 9 to thereby cause the rubber blanket 9 to be retained tightly over the circumferential surface of the blanket cylinder 1.

The printing machine further includes a washing roller 2, and means (not shown) for moving the washing roller between a cleaning position and an idle position. Such means for moving the washing roller are conventional, and may include, for example, a pivotal lever arm. When the washing roller 2 is in the cleaning position, the surface 11 of the washing roller 2 engages the blanket cylinder 1 at position 3. Conversely, when the washing roller 2 is in the idle position, the surface 11 of the washing roller 2 does not engage the rubber blanket cylinder 1. As shown in the Figure, the washing roller 2 is in its cleaning position, that is, the washing roller 2 is in position to engage the rubber blanket cylinder 1 as it rotates.

The surface 11 of the washing roller 2 is made of a wettable absorbent material, which preferably is a soft-elastic material. Preferably, the washing roller 2 fluidically communicates with a source (not shown) of washing fluid, whereby the surface 11 of the washing roller 2 is wetted by the washing fluid to thereby form a washing surface.

In accordance with the invention, the washing roller 2 is rotatable in the same direction as the direction of rotation of the blanket cylinder 1 and also in a direction opposite the direction of rotation of the blanket cylinder 1. Arrow 4 illustrates rotation of the washing roller 2 in a direction opposite the direction of rotation of the blanket cylinder 1. By "opposite direction" is meant that the engaging surfaces of the washing roller 2 and blanket cylinder 1 move in opposite the directions, although both the roller 2 and cylinder 1 are rotating in a clockwise direction in the view taken in the Figure. Arrow 8 illustrates rotation of the washing roller 2 in the same direction as the direction of rotation of the blanket cylinder 1.

In carrying out the present inventive method, the direction of rotation of the washing roller 2 is preferably alternated. For example, it may be sufficient to drive the washing roller 2 in the same direction as the direction of rotation of the blanket cylinder 1 only when the region of the print end edge 7 is being cleaned. Alternatively, the washing roller 2 may be driven in the same direction as the direction of rotation of the blanket cylinder 1 over at least a complete revolution of the blanket cylinder 1. The washing roller 2 instead may be driven alternately in the opposing direction and in the same direction as the direction of rotation of the blanket cylinder 1 for equal periods of rotation of the blanket cylinder 1. If the washing roller 2 is so driven, the identical periods of rotation preferably are each at least equal to one complete revolution of the blanket cylinder 1.

In addition, the printing machine may include means (not shown) for sensing the rotational position of the rotating blanket cylinder 1 and for generating a signal when the blanket cylinder 1 has reached a predetermined rotational position or has rotated a predetermined number of revolutions. Further, the printing machine may include means (not shown) for controlling the direction of rotation of the washing roller, wherein the means for controlling the direction of rotation of the washing roller are responsive to the signal generated by the sensing means. If the printing machine is so equipped, the present inventive method then includes the steps of rotating the washing roller in a first direction until the blanket cylinder 1 reaches the predetermined rotational position or has rotated a predetermined number of revolutions, and thereafter reversing the direction of rotation of the washing roller. The alternating of the direction of rotation of washing roller 2 preferably continues until the cleaning cycle is complete.

Thus, the present invention satisfies the aforesaid general objects. A method for cleaning a rotating cylinder in a printing machine is provided. When the method is employed to clean a rotating cylinder in a printing machine, print residue deposits are reduced or eliminated.

While particular embodiments of the invention have been shown and described, it will of course be understood that the invention is not limited thereto since modifications may be made by those skilled in the art, particularly in light of the foregoing teachings. For example, although the invention has been described as applied to the cleaning of the blanket cylinder, the inventive method is equally applicable to the cleaning of the impression cylinder. It is, therefore, contemplated by the appended claims to cover any such modifications as incorporate those features which constitute the essential features of these improvements within the true spirit and scope of the invention.

What is claimed is:

1. A method for cleaning a rotating cylinder in a printing machine, the method comprising the steps of: providing a printing machine including a rotatable washing roller fluidically communicating with a source of washing fluid, whereby the surface of said washing roller is wetted to thereby provide a washing surface for said washing roller, said printing machine including means for moving said washing roller between a cleaning position in which said surface of said washing roller engages said rotating cylinder and an idle position in which said surface of said washing roller does not engage said rotating cylinder, moving said washing roller to said washing position;

rotating said washing roller in a first direction opposite to the direction of rotation of said rotating cylinder to thereby clean at least a first portion of said rotating cylinder; and rotating said washing roller in a second direction the same as the direction of rotation of said rotating cylinder to thereby clean at least a second portion of said rotating cylinder.

2. A method according to claim 1, wherein said rotating cylinder is a rubber-blanket cylinder, including a rubber blanket over a portion of the circumference of said rubber-blanket cylinder, said rubber blanket including a print start edge and a print end edge, said print start edge leading said print end edge during the rotation of said rotating cylinder, wherein said rubber-blanket cylinder includes an axial channel, said axial channel including means for retaining said rubber blanket, wherein said step of rotating said washing roller in the same direction as the direction of rotation of said rotating cylinder is performed while said washing roller engages said print end edge of said rubber blanket.

3. A method according to claim 1, wherein said step of rotating said washing roller in the same direction as the direction of rotation of said rotating cylinder is performed over at least one complete revolution of said rotating cylinder.

4. A method according to claim 1, wherein said step of rotating said washing roller in a direction opposite to the direction of rotation of said rotating cylinder and said step of rotating said washing roller in the same direction as the direction of rotation of said rotating cylinder are performed for identical periods of time.

5. A method according to claim 4, wherein said period of time is at least one complete revolution of said rotating cylinder.

6. A method according to claim 1, wherein said steps of rotating said washing roller in a first direction is performed until said rotating cylinder reaches a predetermined position; and thereafter rotating said washing roller in said second direction opposite to said first direction.

* * * * *